US011660883B2

(12) United States Patent
Sugiura et al.

(10) Patent No.: US 11,660,883 B2
(45) Date of Patent: May 30, 2023

(54) IMAGE RECORDING APPARATUS

(71) Applicant: Brother Kogyo Kabushiki Kaisha, Nagoya (JP)

(72) Inventors: Keita Sugiura, Toyokawa (JP); Takaaki Oguchi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/346,396

(22) Filed: Jun. 14, 2021

(65) Prior Publication Data

US 2021/0402804 A1 Dec. 30, 2021

(30) Foreign Application Priority Data

Jun. 24, 2020 (JP) ..... JP2020-108606

(51) Int. Cl.

| | |
|---|---|
| ***B65H 20/02*** | (2006.01) |
| ***B65H 16/04*** | (2006.01) |
| ***B41J 11/00*** | (2006.01) |
| ***G03G 15/00*** | (2006.01) |
| ***B65H 16/06*** | (2006.01) |

(52) U.S. Cl.

CPC ..... *B41J 11/007* (2013.01); *B65H 16/04* (2013.01); *B65H 16/06* (2013.01); *B65H 20/02* (2013.01); *G03G 15/6529* (2013.01); *B65H 2402/32* (2013.01); *G03G 15/6517* (2013.01)

(58) Field of Classification Search

CPC combination set(s) only.

See application file for complete search history.

(56) References Cited

U.S. PATENT DOCUMENTS 3,856,128 A * 12/1974 Taggart ..... B41J 11/42 377/2
6,722,238 B2 * 4/2004 Shinga ..... B41J 11/663 399/385

(Continued)

FOREIGN PATENT DOCUMENTS

EP 1101718 A2 * 5/2001 ..... B65H 1/14
JP 2004-114363 A 4/2004

(Continued)

OTHER PUBLICATIONS

U.S. Appl. No. 17/345,018, filed Jun. 11, 2021, Sugiura, Keita.

(Continued)

*Primary Examiner* — Jennifer Bahls

(74) *Attorney, Agent, or Firm* — Burr Patent Law, PLLC

(57) ABSTRACT

There is provided an image recording apparatus having a housing having a front wall and a rear wall, and a right wall and a left wall defining an internal space of the housing, a sheet roll holder configured to hold a sheet roll, a supporting member configured to support the sheet roll, the supporting member extending in an axial direction of the sheet roll and being supported by the sheet roll holder, a sheet conveyer arranged in an internal space of the housing, the sheet conveyer being configured to convey a sheet unwound from the sheet roll, and a recording device configured to record an image on the sheet unwound from the sheet roll and conveyed by the sheet conveyer. The sheet roll holder is configured to be slidable with respect to the housing so as to be detachable from and attachable to the housing.

13 Claims, 4 Drawing Sheets

(56) References Cited

U.S. PATENT DOCUMENTS

| | | | | |
|---|---|---|---|---|
| 2011/0229241 | A1* | 9/2011 | Takahashi | B65H 75/14 242/613 |
| 2012/0249625 | A1 | 10/2012 | Asada | |
| 2014/0099150 | A1* | 4/2014 | Matsumoto | B41J 13/08 400/619 |
| 2016/0041515 | A1* | 2/2016 | Numazu | G03G 15/652 399/384 |
| 2018/0290854 | A1* | 10/2018 | Foreman | B65H 35/0033 |

FOREIGN PATENT DOCUMENTS

| | | | |
|---|---|---|---|
| JP | 2006-016167 | A | 1/2006 |
| JP | 4775646 | | 9/2011 |
| JP | 2015-120578 | A | 7/2015 |
| JP | 2018-075792 | A | 5/2018 |

OTHER PUBLICATIONS

Office Action, U.S. Appl. No. 17/345,018, dated Jun. 22, 2022 (9 pages).
U.S. Final Office Action, U.S. Appl. No. 17/345,018, dated Oct. 14, 2022 (10 pages).

* cited by examiner

IMAGE RECORDING APPARATUS

CROSS-REFERENCE TO RELATED APPLICATIONS

This application claims priority under 35 U.S.C. § 119 from Japanese Patent Application No. 2020-108606 filed on Jun. 24, 2020. The entire subject matter of the application is incorporated herein by reference.

BACKGROUND

Technical Field

The present disclosures relate to an image recording apparatus configured to form an image on a continuous sheet that is unwound from a roll body (i.e., a recording sheet roll) and loaded to a sheet supporting table.

Related Art

There has been known an image recording apparatus configured to form an image on a continuous sheet unwound from a roll body, which is a continuous recording sheet in a rolled form.

The roll body is attached to an attachment member provided in an internal space of the image recording apparatus. Typically, a roll body insertion opening is formed on a housing of the image recording apparatus, and an external cover configured to rotate to open and close the insertion opening is provided to the housing of the image recording apparatus.

SUMMARY

The sheet of the roll body is unwound from the roll body and conveyed to a platen at which an image is printed thereon. If a conveyance path extending from the roll body to the printing part is relatively long, a spatial efficiency in arranging respective components in the internal space of the image recording apparatus becomes low, and the image recording apparatus tends to be upsized.

Additionally, sufficient space must be provided around the image recording apparatus to allow the external cover to rotate and be located at its open position. It is noted that, if the roll body insertion opening is made wider so that the roll body can easily be attached to the attachment part, a larger external cover is required, which requires a larger space therefor.

Further, after attaching the roll body to the image recording apparatus, it is necessary for a user to unwound the sheet from the roll body and set the same to a component such as a roller pair configured to hold and convey the sheet. However, if there is not sufficient space around the image recording apparatus, it is difficult for the user to visibly recognize the internal space of the image recording apparatus, which results in poor workability.

According to aspects of the present disclosures, there is provided an image recording apparatus having a housing having a front wall and a rear wall spaced from each other in a front-rear direction, and a right wall and a left wall spaced from each other in a right-left direction, the right wall, the left wall, the front wall and the rear wall defining an internal space of the housing, a sheet roll holder configured to hold a sheet roll, a supporting member configured to support the sheet roll, the supporting member extending in an axial direction of the sheet roll and being supported by the sheet roll holder, a sheet conveyer arranged in an internal space of the housing, the sheet conveyer being configured to convey a sheet unwound from the sheet roll, and a recording device arranged in the internal space of the housing, the recording device being configured to record an image on the sheet unwound from the sheet roll and conveyed by the sheet conveyer. The sheet roll holder is configured to be slidable with respect to the housing so as to be detachable from and attachable to the housing.

DETAILED DESCRIPTION OF THE EMBODIMENT

Hereinafter, an image recording apparatus 10 according to an embodiment of the present disclosures will be described with reference to the accompanying drawings. It should be noted that an embodiment described below is only an illustrative example, and various modifications and/or improvements of the embodiment can be made without departing from aspects of the present disclosures.

In the following description, a term "one-way direction" refers to a one-way direction from one point toward another point, while a term "direction" or "both-way direction" refers to a both-way direction between one point and another point.

In the following description, a vertical direction (an up-down direction) 7, which is a both-way direction, is defined with reference to a state in which the image recording apparatus 10 is installed and ready for use (i.e., a state shown in FIG. 1). Further, a front-rear direction 8, which is also a both-way direction, is defined regarding a side in which a discharge opening 13 is provided as a front side, and a right-left direction 9, which is also a both-side direction, is defined with the image recording apparatus 10 viewed from its front side. Furthermore, right, left, front, rear, up and down sides are indicated by arrows in each of FIG. 1-4.

Appearance of Image Recording Apparatus

Figure 1:
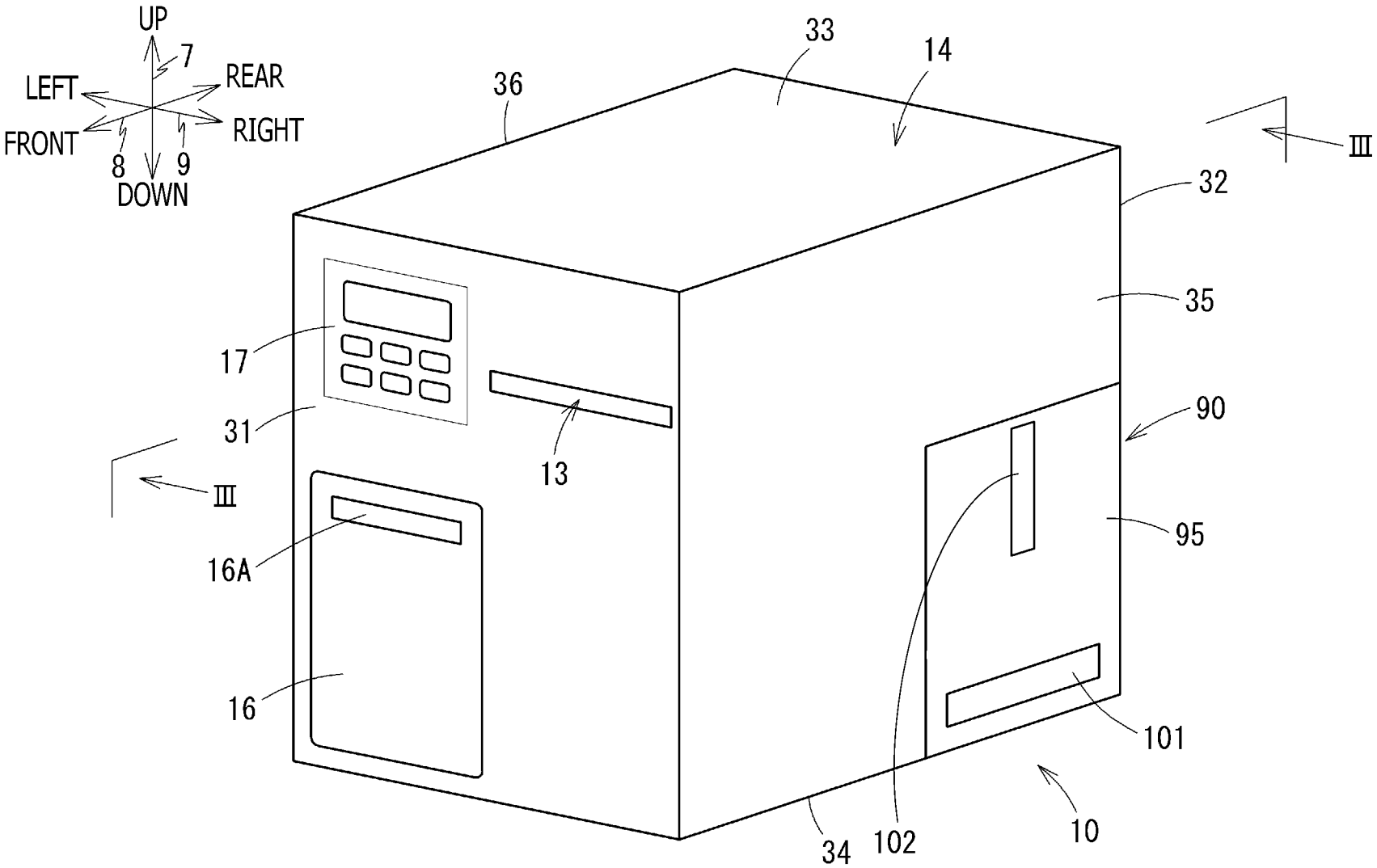
FIG. 1 is a perspective view of an image recording apparatus according to an embodiment of the present disclosures.

FIG. 1 is a perspective view of the image recording apparatus 10, which is configured to form an image onto a continuous sheet unwound from a roll body 11 (see FIG. 3) in accordance with an inkjet printing method.

The image recording apparatus 10 has a housing 14, which has an approximately rectangular parallelopiped shape. An internal space of the housing 14 is defined by walls. As shown in FIG. 1, the housing 14 has a right wall 35 and a left wall 36, which are arranged to face and be spaced from each other in the right-left direction 9, an upper wall 33 and a lower wall 34, which are arranged to face and to be spaced from each other in the up-down direction 7, and a front wall 31 and a rear wall 32, which are arranged to face and to be spaced in the front-rear direction 8. Each of the upper wall 33 and the lower wall 34 connects the right wall 35 and the left wall 36, and each of the front wall 31 and the rear wall 32 connects the upper wall 33 and the lower wall 34.

The housing 14 has a suitable size such that the image forming apparatus 10 can be placed and used on a desk. However, it is also possible to install and use the image recording apparatus 10 on the floor.

As mentioned above, the discharge opening 13 is formed on the front wall 31. The discharge opening 13 is a through opening penetrating through the front wall 31. Through the discharge opening 13, the internal space of the image recording apparatus 10 communicates with the outside. An operation panel 17 is arranged on the left side with respect to the discharge opening 13 on the front wall 31. The operation panel 17 has a display and input keys. The user can input various operation commands and the like to operate the image recording apparatus 10 through the operation panel 17.

A cover 16 is provided on a lower side with respect to the operation panel 17 (i.e., a lower left side) on the front wall 31. A finger grip 16A is formed on au upper end portion of the front side of the cover 16. The finger grip 16A is formed to be a concave portion or a protruded potion with respect to a front surface of the cover 16 so that the user can hook a finger when moving the cover 16.

Figure 2:
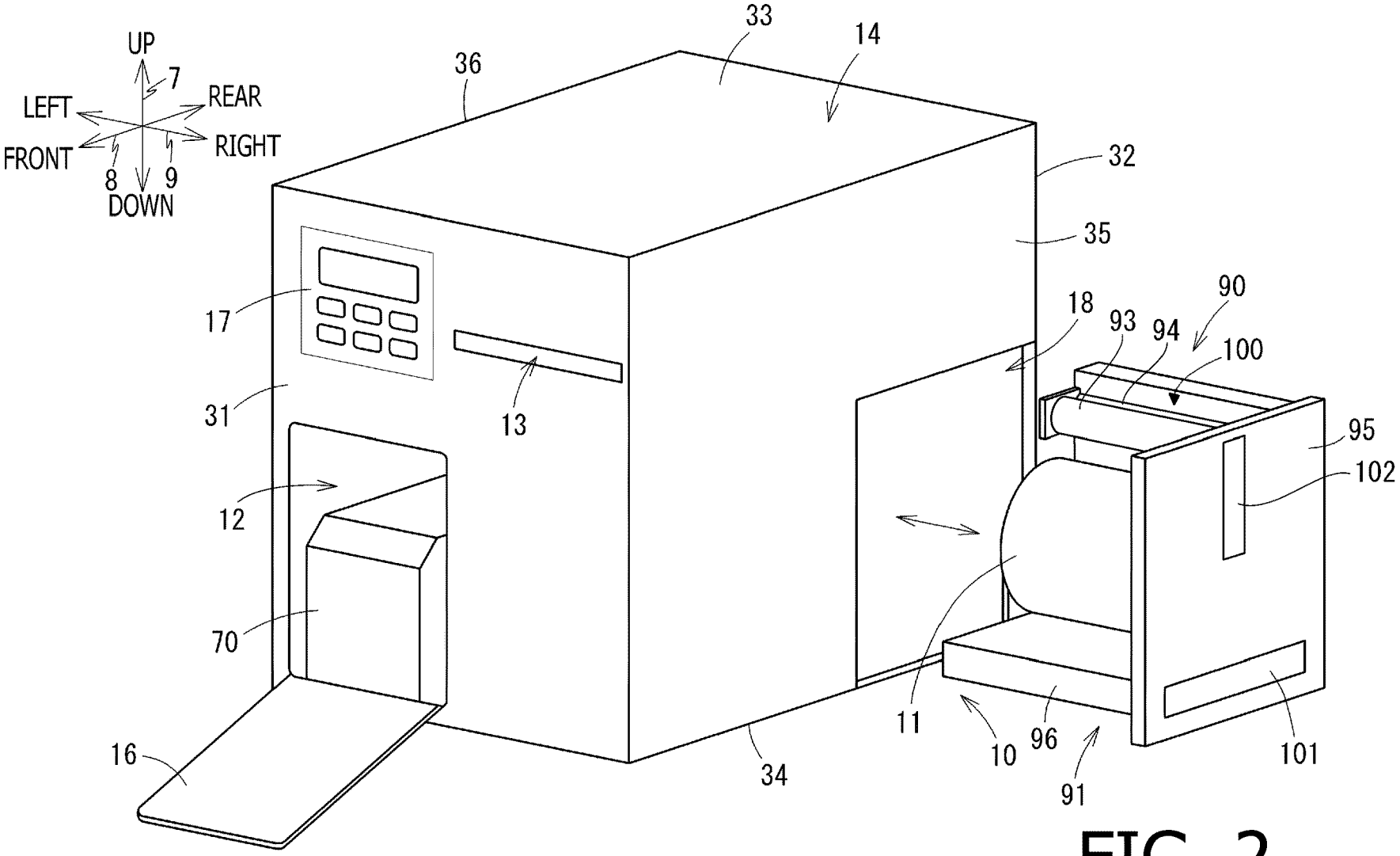
FIG. 2 is a perspective view of the image recording apparatus when a cover is fully opened, and a holder is pulled out from a housing.

As shown in FIG. 2, the cover 16 is configured to be opened and closed as the user rotates the cover 16 about a rotation axis at a lower end of the cover 16 and extending along the right-left direction 9. When the cover 16 is opened, the internal space of the housing 14 is exposed through an opening 12. An outer surface of the cover 16 forms, when closed, a part of the front wall 31 of the housing 14.

As shown in FIG. 2, a tank (or a plurality of tanks) 70 is arranged in the internal space of the housing 14. The tank 70 is located on the rear side with respect to the cover 16 in the closed state. The tank 70 is configured to hold ink. According to the embodiment, the tank 70 is of a cartridge type and is detachably attached to the housing 14. The ink contained by the tank 70 is supplied to a print head 24 via a tube 71 (see FIG. 3).

The ink is a liquid that contains pigments and other substances. The ink has a viscosity suitable for uniformly dispersing the pigment. The pigment defines a color of the ink.

As shown in FIG. 2, a holder insertion opening 18 is formed on a lower rear portion of the right wall 35. The internal space of the housing 14 communicates with the outside through the holder insertion opening 18. A holder 90 can be slidably inserted into the internal space of the housing 14 through the holder insertion opening 18. As shown in FIG. 1, when the holder 90 is fully inserted inside the housing 14 through the holder insertion opening 18, a holder outer wall 95 of the holder 90 constitutes a right surface (i.e., an example of a side wall) of the housing 14 in association with the right wall 35 of the housing 14. The detailed structure of the holder 90 will be described later.

Internal Structure of Image Recording Apparatus

Figure 3:
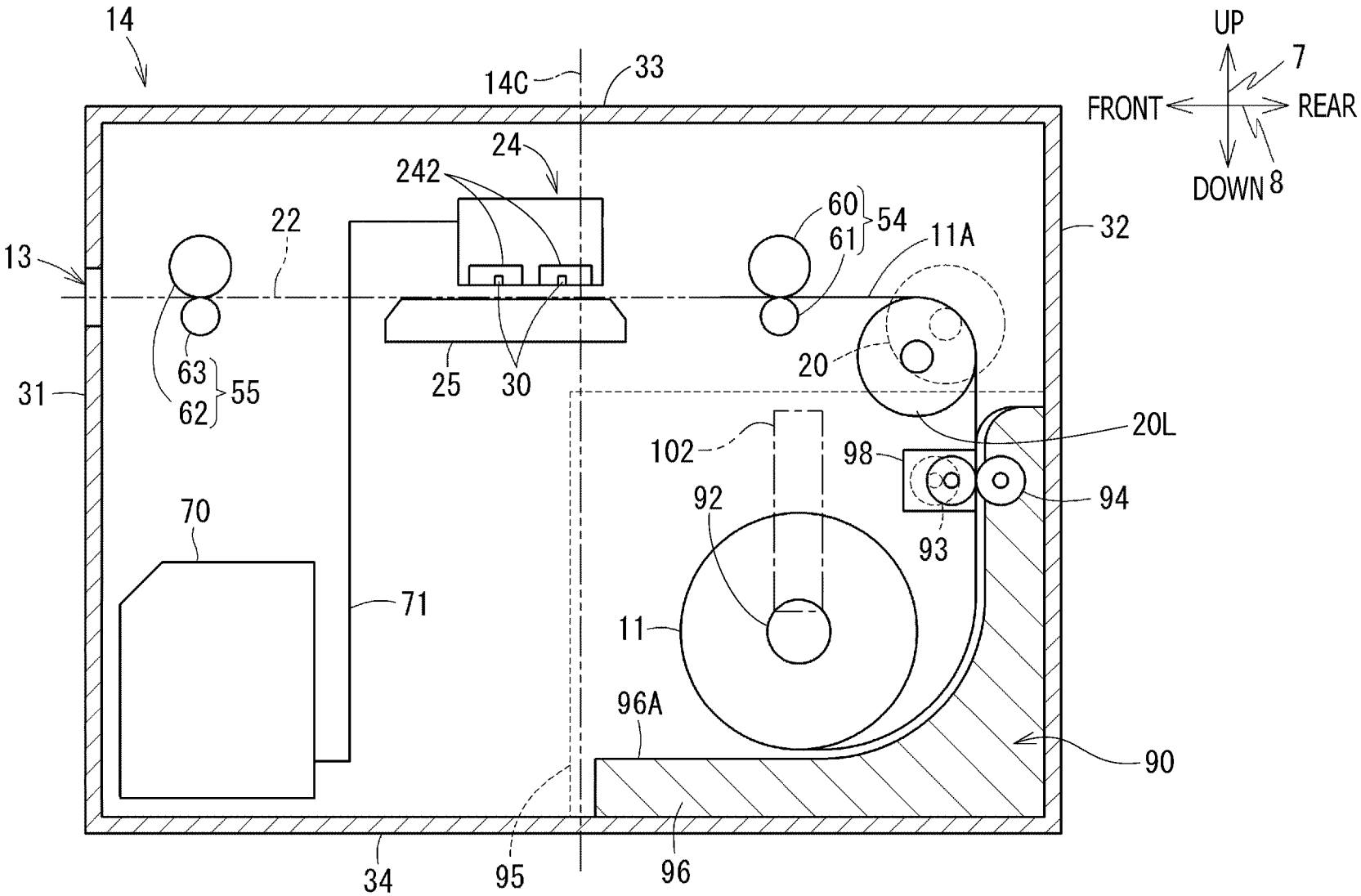
FIG. 3 is a cross-sectional side view of the image recording apparatus taken along line III-III shown in FIG. 1.

As shown in FIG. 3, a conveyance path 22 is defined in the internal space of the housing 14. In the internal space of the housing 14, a guide roller 20, a first conveyance roller pair 54 (i.e., rollers 60 and 61), a second conveyance roller pair 55 (i.e., rollers 62 and 63), a platen 25 and the tank 70 are provided. Although not shown in FIG. 3, a maintenance unit including a cap configured to cover a nozzle area of the print head 24, a wiper configured to wipe the nozzle surface, a control circuit board, and a power supply circuit may also be arranged in the internal space of the housing 14.

The print head 24 includes discharge modules 242. Each of the discharge modules 242 is configured such that a plurality of nozzles 30 is arranged side by side along the right-left direction 9. Ink droplets are discharged downward from the plurality of nozzles 30 toward the platen 25. Although only two rows of nozzles 30 spaced in the front-rear direction 8 are shown in FIG. 3, more than two rows of nozzles may be arranged in the front-rear direction 8, and each row has a plurality of nozzles 30 arranged in the right-left direction 9.

The guide roller 20 is arranged in the internal space of the housing 14, and in the vicinity of the rear wall 32. The guide roller 20 is a cylindrical roller of which a rotation axis extends in the right-left direction 9. A sheet 11A, which is unwound and led upward from the roll body 11, is wound around the guide roller 20 and extends frontward toward the front wall 31. On a circumferential surface (i.e., a roller surface) of the guide roller 20, a surface opposite to a printing surface of the sheet 11A contacts.

The guide roller 20 is configured to move between a first position which is indicated by the solid line, and a second position which is indicated by the broken line in FIG. 3. The first position is a position on an inner side at a concave curvature of the curved portion of the conveyance path 22 compared to the second position. Although not shown in FIG. 3, the guide roller 20 is urged by an elastic member such as a spring toward the second position.

As the sheet 11A unwound from the roll body 11 wraps around the guide roller 20, and held by the first conveyance roller pair 54 and the nip rollers 93 and 94, a tension of the sheet 11A therebetween is applied to the guide roller 20, thereby the guide roller 20 being urged to move from the second position and located at the first position. A lower part 20L, which is a part of the guide roller 20, is located below an upper end of the guide roller 20 is located on a lower side with respect to an upper end of the holder outer wall 95 in a state where the holder 90 is attached to the housing 14. The outer wall 95 of the holder 90 is indicated by broken lines in FIG. 3.

As shown in FIG. 3, the conveyance path 22 is formed from a position in the vicinity of an upper rear end portion of the holder 90 to the discharge opening 13 via the guide roller 20.

There are provided guide members (not shown) to the housing 90 and defining the conveyance path 22 having a concavely curved guide surface at a portion facing the guide roller 20 so that the conveyance path 22 from the upper rear end portion of the holder 90 changes its extending direction from the up-down direction 7 to the front-rear direction 8 at the guide roller 20, and then extends to the first conveyance roller pair 54.

A part of the conveyance path 22 from the guide roller 20 to the discharge opening 13 extends substantially linearly in the front-rear direction 8. The conveyance path 22 is a path through which the sheet 11A is conveyed. The conveyance path 22 is defined by the guide members, which are arranged to be spaced in the up-down direction 7, the guide roller 20, the print head 24 and the platen 25. Between the guide roller 20 and the discharge opening 13, a frontward direction, which is the one-way direction, is the conveying direction of the sheet 11A in the conveyance path 22.

As shown in FIG. 3, the first conveyance roller pair 54 is provided along the conveyance path 22 in the internal space of the housing 14, at a position on a downstream side in the conveying direction, with respect to the guide roller 20 and on an upstream side in the conveying direction, with respect to the print head 24. The first conveyance roller pair 54 has a first conveyance roller 60 and a pinch roller 61. The second conveyance roller pair 55 is provided along the conveyance path 22 in the internal space of the housing 14 at a position on a downstream side with respect to the print head 24. The second conveyance roller pair 55 has a second conveyance roller 62 and a pinch roller 63. The first conveyance roller 60 and the second conveyance roller 62 rotate as a rotation force of a motor (not shown) is transmitted. The pinch roller 61 is urged toward the first conveyance roller 60, and the pinch roller 63 is urged toward the second conveyance roller 62. The first conveyance roller pair 54 and the second conveyance roller pair 55 convey the sheet 11A in the conveying direction along the conveyance path 22 as the first conveyance roller 60 and the second conveyance roller 62 hold the sheet 11A therebetween and rotate, and the second conveyance roller 62 and the pinch roller 63 hold the sheet 11A therebetween.

As shown in FIG. 3, the print head 24 and the platen 25 are arranged between the first conveyance roller pair 54 and the second conveyance roller pair 55, and on opposite sides with respect to the conveyance path 22.

As shown in FIG. 3, the platen 25 is arranged below the print head 24. An upper surface of the platen 25 is configured to be parallel to a surface of the print head 24 on which orifices for respective nozzles 30 are formed. A dimension of the upper surface of the platen 25 in the right-left direction 9 is larger than a dimension of the roll body in the right-left direction 9. The upper surface of the platen 25 supports, from below, the sheet 11A conveyed by the first conveyance roller pair 54 and the second conveyance roller pair 55. Although not shown in FIG. 3, it is also possible to have the sheet 11A attracted onto the upper surface of the platen 25 by electrostatic force or negative pressure. Since the platen 25 is not fixed to the holder 90, the platen 25 stays unmoved in the internal space of the housing 14 when the holder 90 is pulled out from the housing 14.

Configuration of Holder

As shown in FIGS. 1 and 2, the holder 90 can be slidably pulled out from and inserted into the housing 14, in the right-left direction 9, through the holder insertion opening 18 formed on the right wall 35 of the housing 14.

Figure 4:
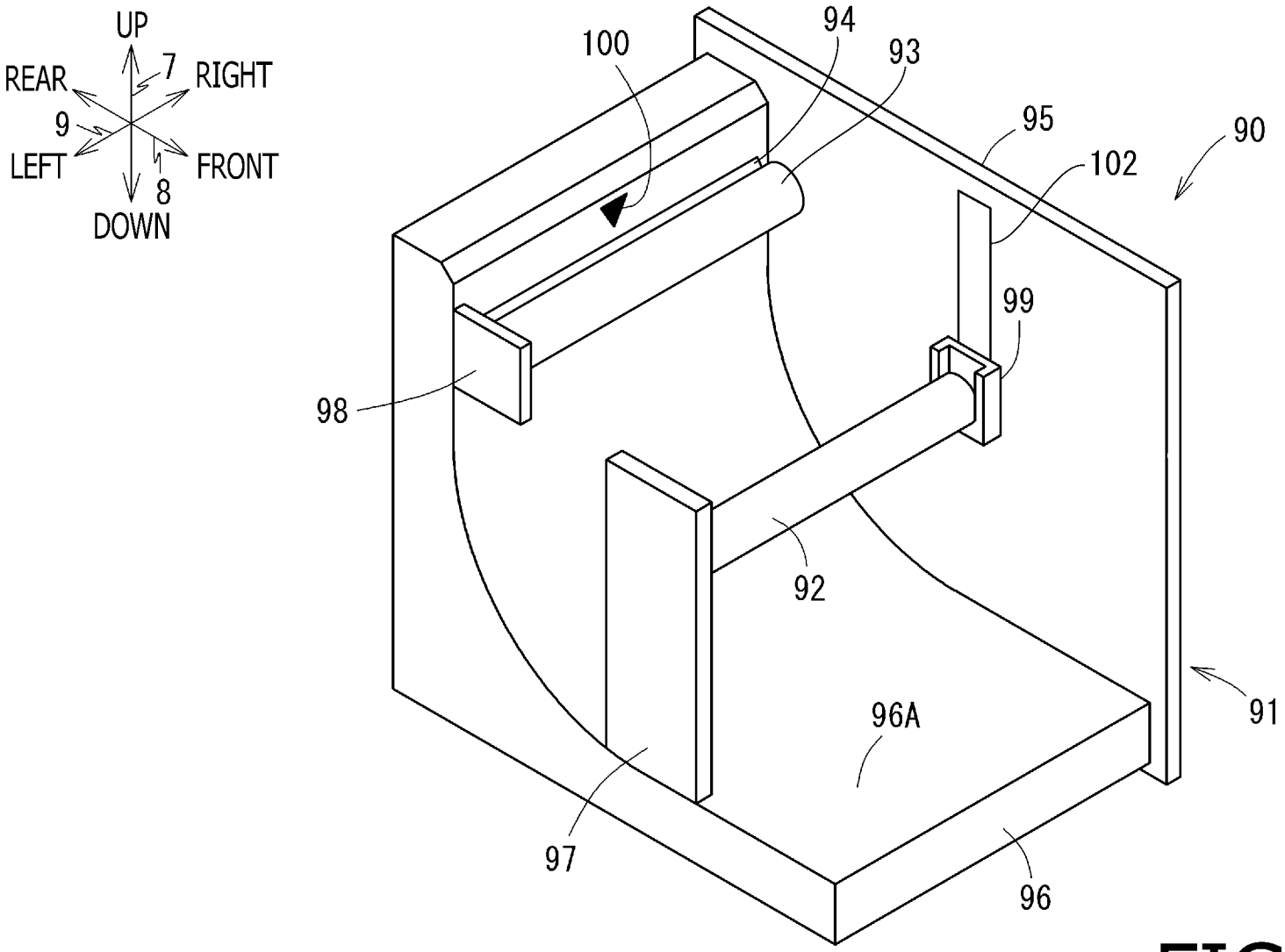
FIG. 4 is a perspective view of the holder.

As shown in FIGS. 3 and 4, the holder 90 has a holder chassis 91, a spindle 92, and the nip rollers 93 and 94.

The holder chassis 91 has a holder outer wall 95 and a main body 96. The holder outer wall 95 closes the holder insertion opening 18 when the holder 90 is fully inserted in the internal space of the housing 14 through the holder insertion opening 18 (see FIG. 1). In this state (i.e., when the holder 90 is fully inserted in the housing 14), the outer surface of the holder outer wall 95 and the outer surface of the right wall 35 of the housing 14 are on the same plane.

The main body 96 is an approximately L-shaped side view and has a part extending along the lower wall 34 of the housing 14 and a part extending along the rear wall 32 of the housing 14. A part of a curved surface 96A of the main body 96, which faces upward and frontward, guides the sheet 11A unwound from the roll body 11. The right surface of the main body 96 is connected to the holder outer wall 95. The main body 96 has a supporting member 97 that supports a left end of the spindle 92 and a supporting member 98 that supports a left end of the nip roller 93. The supporting member 97 is arranged at the left end of the main body 96 and extends upward from the curved surface 96A. The supporting member 98 is arranged at the left end of the main body 96 and extends frontward from the curved surface 96A. Both the supporting elements 97 and 98 face the holder outer wall 95 in the right-left direction 9. Upper, left, and front sides of the main body 96 are open to the outside with no walls present.

The spindle 92 extending in the right-left direction 9 is arranged on an inner side of curvature of the curved surface 96A of the main body 96. A right end of the spindle 92 is rotatably supported by a supporting member 99 provided on a left surface of the holder outer wall 95. A left end of the spindle 92 is rotatably supported by the supporting member 97. The spindle 92 is detachably attached to the supporting elements 97 and 99. The spindle 92 is inserted into the center (i.e., a hollow core) of the roll body 11 and supports the roll body 11. The spindle 92 is rotated by a rotating force transmitted from a motor (not shown) arranged in the internal space of the housing 14.

Although not shown in FIG. 4, there is a hole in the supporting element 97, and a left end of the spindle 92 is inserted through the hole and rotatably supported thereby. The left end of the spindle 92 is connected to a transmission mechanism (e.g., a gear train) provided to the main body 96, and the spindle 92 rotates as a driving force is transmitted through the transmission mechanism. The roll body 11 has a hollow core, and the spindle 92 has a portion configured to engage with an inner surface of the hollow core of the roll body. According to the above configuration, when the spindle 92 rotates, the roll body 11 rotates. It should be noted that the above-described configuration of enabling the rotation of the roll body 11 in association with the rotation of the spindle 92 is only an example. That is, a configuration of enabling the rotation of the roll body 11 in association with the rotation of the spindle motor 92 is not necessarily limited to a specific one, but any possible configuration may be employed.

As shown in FIG. 3, in a state where the holder 90 is attached to the housing 14, a central portion of the spindle 92 in the front-rear direction 8 is located on a rear side with respect to a central position 14C (indicated by a two-dotted line in FIG. 3) of the housing 14 in the front-rear direction 8.

As shown in FIGS. 3 and 4, the nip roller 93 extending in the right-left direction 9 is arranged on the inner side with respect to the curvature of the curved surface 96A of the main body 96. The nip roller 93 is arranged on an upper rear side with respect to the spindle 92. A right end of the nip roller 93 is rotatably supported by the left surface of the holder outer wall 95. A left end of the nip roller 93 is rotatably supported by the supporting member 98. The nip roller 93 is configured to rotate about an axis extending in the right-left direction 9.

The nip roller 93 is configured such that, in a state where the nip roller 93 is supported by the holder outer wall 95 and the supporting member 98, the nip roller 93 is movable, in the front-rear direction 9, between a holding position shown by solid lines and a non-holding position shown by broken lines in FIG. 3. The front-rear movement of the nip roller 93 is performed as a driving force is transmitted from a motor (not shown) or a magnet valve.

It is noted that a configuration of enabling the nip roller 93 to move between the holding position and the non-holding position is not necessarily be limited to a specific configuration, but any suitable configuration may be employed. An example of possible configurations will be described below. The supporting member 98 has a groove cut along the direction of movement of the nip roller 93. The shaft of the nip roller 93 is inserted into this groove. In this case, the holder outer wall 95 also has a similar groove, and both ends of the shaft of the nip roller 93 are inserted into the grooves, thereby the shaft of the nip roller 93 being slidably supported. In addition, a groove having the same shape is formed in a frame of the main body, and the shaft of the nip roller 93 is also inserted into the groove of the frame of the main body through the groove of the support member 98. There is further provided a cam, which is rotated by the driving force from the motor of the main body, such that the cam is in contact with the shaft of the nip roller 93, and the rotation of the cam causes the shaft of the nip roller 93 to move along the groove to move between the holding position and the non-holding position.

When the nip roller 93 is located at the holding position, the nip roller 93 and another nip roller 94 hold the sheet 11A therebetween. The nip roller 93 at the non-holding position is spaced from the nip roller 94, and a distance between the nip roller 93 and the nip roller 94 is much greater than the thickness of the sheet 11A. Therefore, when the nip roller 93 is located at the non-holding position, the nip roller 93 and the nip roller 94 do not hold the sheet 11A therebetween.

The nip roller 94 is provided to the main body 96 of the holder 90. The nip roller 94 is located on a rear side with respect to the nip roller 93. The nip roller 94 is configured to rotate about an axis extending in the right-left direction 9. A part of the nip roller 94 is located on a rear side with respect to the curved surface 96A of the main body 96 (see FIG. 3). A front part of the nip roller 94 is slightly protruded with respect to the curved surface 96A. The front part of the nip roller 94 protruded from the curved surface 96A is in contact with the nip roller 93 when the nip roller 93 is located at the holding position. The nip roller 94 is rotated as a rotating force is transmitted from a motor (not shown) arranged in the internal space of the housing 14. As shown in FIG. 3, in a state where the holder 90 is attached to the housing 14, the nip rollers 93 and 94 and the guide roller 20 are located on the rear side with respect to the spindle 92. In addition, in the state where the holder 90 is attached to the housing 14, the nip rollers 93 and 94 are located on an upper side, in the up-down direction 8, with respect to a central axis of the spindle 92 and on a downside, in the up-down direction 8, with respect to the guide roller 20.

As shown in FIG. 4, a mark 100 is formed on an upper end portion of the curved surface 96A. The mark 100 is formed at an approximately central part, in the right-left direction 9, of the upper end portion of the curved surface 96A. According to the present embodiment, the mark 100 is a down-pointing triangle as shown in FIG. 4. The position indicated by the mark 100 (in this embodiment, a position indicated by a bottom vertex of the down-pointing triangle) is a position of a leading end of the sheet 11A unwound from the roll body 11. It is noted that the mark 100 may be formed by embossing or other unevenness, or may be printed by ink. Alternatively, the mark 100 may be formed by a sticker with the mark 100 printed thereon may be affixed to the curved surface 96A.

As shown in FIGS. 1 and 2, a finger grip 101 is formed as a portion concaved leftward from the right surface of the holder outer wall 95. In a state where the holder 90 is attached to the housing 14 as shown in FIG. 1, the finger grip 101 is exposed to outside the housing 14. Therefore, the user can hold the finger grip 101 by inserting the fingers onto the finger grip 101 from the right side (i.e., outside) of the holder 90. It is noted that the finger grip 101 may be formed to have another shape. For example, the finger grip 101 may be a C-shaped handle protruding rightward from the right surface of the holder outer wall 95.

A translucent window 102 is formed on the right surface of the holder outer wall 95. The window 102 is formed on an upper side with respect to the handle 101 on the right surface of the holder outer wall 95. The window 102 enables the user to see the inner side of the holder 90 from the outside (i.e., the right side). Although the size and shape of the window 102 should not be limited to a particular one, it is preferable that the window 102 enables the user to check the remaining amount of the sheet of the roll body 11 held by the spindle 92. For example, a lower end of the window 102 in the vertical direction 7 may be located in the vicinity of a position of the spindle 92, and an upper end of the window 102 may be located in the vicinity of an upper end (i.e., an outermost portion) of a new roll body 11 held by the spindle 92 as shown in FIGS. 3 and 4. The window 102 may be a through opening or an opening to which a translucent element is fitted.

Operation of Image Recording Apparatus

Hereinafter, an operation of the image recording apparatus 10 will be described. When receiving print data, the image recording apparatus 10 controls a motor (not shown) to rotate the spindle 92, the guide roller 20, the first conveyance roller 60, and the second conveyance roller 62. At an initial state, the nip roller 93 is located at the non-holding position. Accordingly, the leading end of the sheet 11A of the roll body 11 is fed toward a position below the print head 24. A surface of the sheet 11A facing the print head 24 is an outer surface when wounded as the roll body 11. The image recording apparatus 10 controls the motor to rotate respective rollers to feed the sheet 11A, while causes the print head 24 to eject ink droplets toward the sheet 11A based on the print data. The ink droplets ejected from the print head 24 adhere onto the sheet 11A supported on the platen 25.

In response to completion of the printing based on the print data, the sheet is conveyed until a printed portion of the sheet 11A is discharged from the housing 14 through the discharge opening 13. Thereafter, the image recording apparatus 10 controls the motor (not shown) to stop rotating the spindle 92, the guide roller 20, the first conveyance roller 60, and the second conveyance roller 62.

Replacement of Roll Body

Hereinafter, an operation to replace the roll body 11 will be described. When the sheet 11A is completely consumed for printing and is completely unwound from the roll body 11 supported by the spindle 92, the roll body 11 should be replaced with a new one by the user. When the roll body 11 is replaced, the user firstly holds the finger grip 101 and pulls out the holder 90 rightward. In this way, the holder 90 is slid out of the housing 14 through the holder insertion opening 18 as shown in FIG. 2.

It is noted that the holder 90 may be completely pulled out of the housing 14 as shown in FIG. 4, or may be pulled out to a sufficient extent so that the roll body 11 can be replaced with a new roll body 11.

The user may hold the used roll body 11 and take out the same, together with the spindle 92, from an upper side or a front side of the holder chassis 91. Then, the user may attach a new roll body 11 to the spindle 92, and attach the new roll body 11, together with the spindle 92, to the main body 96. Thereafter, the user unwinds the sheet 11A from the roll body 11 and makes the sheet 11A pass between the nip rollers 93 and 94 until the leading end of the sheet 11A is located to a position indicated by the mark 100.

Thereafter, as the user inserts the holder 90 into the housing 14 through the holder insertion opening 18, the nip roller 93 is moved from the non-holding position to the holding position as described above. In this way, the sheet 11A is held between the nip rollers 93 and 94. Next, when the nip roller 94, the guide roller 20 and the first conveyance roller 60 are rotated, the sheet 11A unwound from the roll body 11 is guided to the first conveyance roller pair 54, and held between two rollers 60 and 61 of the first conveyance roller pair 54. Thereafter, the nip roller 93 is moved from the holding position to the non-holding position.

Effects of Illustrative Embodiment

According to the image forming apparatus 10 described above, the holder 90 can be detached from the housing 14 and the roll bodies 11 can easily be replaced. Accordingly, a setting operation of the roll body 11 can be performed relatively easily. It is particularly easy to set the roll body 11 to the spindle 92 which is located on the rear side of the housing 14.

Further, the leading end of the sheet 11A can be appropriately positioned as the nip roller 93 is located at the holding position. Further, accuracy in conveying the sheet 11A is increased since the holding power of the nip rollers 93 and 94 has no influence when the nip roller 93 is located at the non-holding position.

Furthermore, in a state where the holder 90 is attached to the housing 14, the nip rollers 93 and 94, and the guide roller 20 are located on the rear side with respect to the spindle 92. Therefore, the conveyance path 22 can be shortened, thereby the image forming apparatus 10 being downsized.

Further, in a state where the holder 90 is attached to the housing 14, the nip rollers 93 and 94 are located on an upper side with respect to the center of the spindle 92 and on a lower side with respect to the guide roller 20. Therefore, the conveyance path 22 can be shortened, thereby the image forming apparatus 10 being downsized.

The holder outer wall 95 forms a right side surface in association with right wall 35 of the housing 14. Therefore, a cover for the holder insertion opening 18 is unnecessary, and the holder 90 can be attached to and detached from the housing 14 easily.

It is noted that, in the illustrative embodiment, the holder outer wall 95 forms the right side surface of the housing 14 in association with the right wall 35. The configuration may be modified such that the holder 90 may be pulled out leftward, and the holder outer wall 95 may form a left side surface of the housing 14 in association with the left wall 36.

Since the holder outer wall 95 is provided with the translucent window 102, the status of the roll body 11 is visually recognizable from outside with the holder 90 being attached to the housing 14 (i.e., without pulling out the holder 90 from the housing 14).

In a state where the holder 90 is attached to the housing 14, a part of the guide roller 20 located at the first position is arranged on a lower side with respect to an upper end of the holder outer wall 95. Therefore, the image forming apparatus 10 can be downsized. It is noted that the first position and the second position are merely names indicating relative positional relationship. It is noted that the entire guide roller 20 located at the first position may be arranged on the lower side with respect to the upper end of the holder outer wall 95.

Since the spindle 92 is detachably attached to the main body 96 of the holder 90, the setting of the roll body 11 can be performed easily.

Since the mark 100 is provided on the curved surface 96A of the holder 90, the setting of the sheet 11A pulled out of the roll body 11 can be performed easily.

Modifications

According to the illustrative embodiment, the sheet 11A unwound from the roll body 11 is conveyed upward, inside the holder 90. The configuration may be modified such that the sheet 11A unwound from the roll body 11 may be conveyed rearward initially and then conveyed upward.

According to the illustrative embodiment, the upper side and the front side of the holder chassis 91 are opened. The configuration may be modified such that a cover member to cover the upper side and the front side of the holder chassis 91 may be provided. For example, such a cover may be detachably attached to the holder chassis 91, and the cover may be detached from the holder chassis 91 when the roll body 11 is replaced.

Instead of the nip rollers 93 and 94 provided in the holder 90, urging members configured to urge both side ends, in the right-left direction 9, of the sheet 11A from the front side toward the curved surface 96A may be provided. When such urging members are provided, a pickup roller configured to feed the leading end of the sheet 11A toward the guide roller 20 may additionally be provided to the holder 90.

The arrangement, on the front wall 31 of the image recording apparatus 10, of the discharge opening 13, the cover 16 and the operation panel 17 can be changed. The discharge opening 13, the cover 16 or the operation panel 17 may be arranged on a wall other than the front wall 31. For example, the discharge opening 13 may be provided to the upper wall 33. In such a case, the sheet 11A on which an image has been printed may pass through the discharge opening 13 and is discharged to an upward or obliquely upward direction.

Instead of the guide roller 20, a guide member having a curved surface that contacts the sheet 11A to guide the sheet 11A may be provided.

According to the illustrative embodiment, the first conveyance roller pair 54 and the second conveyance roller pair 55 hold and convey the sheet 11A in the conveyance path 22. It is noted that another conveyance member such as a conveying belt may be used instead of such a configuration.

The tank 70 does not need to be limited to one that stores ink of a singular color of black. For example, multiple tanks respectively storing ink of four different colors (e.g., black, yellow, cyan and magenta) may be provided. Optionally, a heater configured to heat at least one of the sheet and the ink may be provided at a downstream position with respect to the print head 24 along the conveyance path 22 to expedite the drying of the ink. Alternatively, ink containing UV-curing resin may be used. In such a case, a UV irradiator may be provided at a downstream position with respect to the print head 24.

The tank 70 does not need to be limited to a cartridge type tank, but may be one fixed to the housing 14. In such a case, a filling opening may be formed to such a tank, and ink will be refilled into the tank 70 via the filling opening.

According to the illustrative embodiment, the print head 24 employing the inkjet printing technique is used. Alternatively, the image recording apparatus may be one employing an electrophotographic imaging technique or one utilizing a thermal head.

According to the illustrative embodiment, the roll body 11 is held by the spindle 92. It is noted that a stick-like supporting member rotatably supporting the roll body is not necessarily a rotatable member such as the spindle 92. For example, a cylindrical solid or hollow member having an outside diameter smaller than an inside diameter of a core of the roll body 11 may be used as the non-rotatable supporting member.

According to the illustrative embodiment, the image recording apparatus 10 is used with the front wall 31 and the rear wall 32 of the housing 14 extending in the up-down direction 7 and the right-left direction 9, respectively. It is noted that a usage posture of the image recording apparatus 10 does not need to be limited to the posture according to the above-described embodiment.

It is noted that the print head 24 in the above-described embodiment is an example of a recording device according to aspects of the present disclosures. The roll body 11 in the above-described embodiment is an example of a sheet roll according to aspects of the present disclosures. The guide roller 20 in the above-described embodiment is an example of a guide member according to aspects of the present disclosures. The first conveyance roller pair 54 in the above-described embodiment is an example of a conveying mechanism according to aspects of the present disclosures. The second conveyance roller pair 55 in the above-described embodiment is another example of a sheet conveyer according to aspects of the present disclosures. The spindle 92 in the above-described embodiment is an example of the supporting member according to aspects of the present disclosures. The nip roller 93 in the above-described embodiment is an example of the holding member according to aspects of the present disclosures. Further, the nip roller 94 in the above-described embodiment is another example of the holding member according to aspects of the present disclosures.

What is claimed is:

1. An image recording apparatus, comprising:

a housing having a front wall and a rear wall spaced from each other in a front-rear direction, and a right wall and a left wall spaced from each other in a right-left direction, the right wall, the left wall, the front wall and the rear wall defining an internal space of the housing;

a holder having a shaft, the holder being configured to hold a sheet roll by inserting the shaft into a center of the sheet roll;

a roller pair arranged in an internal space of the housing, the roller pair being configured to convey a sheet unwound from the sheet roll; and a recording device arranged in the internal space of the housing, the recording device being configured to record an image on the sheet unwound from the sheet roll and conveyed by the roller pair, wherein the holder is configured to be slidable with respect to the housing so as to be detachable from and attachable to the housing, wherein the holder is arranged on a rear side of the housing, wherein the housing is provided with a conveying mechanism to convey the sheet supplied from the holder along a conveyance passage defined from the rear side to a front side of the housing, wherein the recording device is configured to record the image on the sheet conveyed from the rear side to the front side, wherein a portion of the sheet on which the image is recorded is discharged from a discharge opening formed on the front wall of the housing, and wherein the holder is configured to slide into and out from the housing in the right-left direction.

2. The image recording apparatus according to claim 1, wherein the axial direction being the right-left direction, and wherein the holder is configured to be slidably detached from and attached to the housing in the right-left direction.

3. The image recording apparatus according to claim 2, wherein, in a state where the holder is attached to the housing, a central portion of the shaft, in the font-rear direction, is located on a rear side with respect to a central position of the housing, and wherein the front wall is formed with a discharge opening through which the sheet on which the image has been recorded is discharged.

4. The image recording apparatus according to claim 1, further comprising a nip roller provided to the holder and configured to hold and feed the sheet unwound from the sheet roll to the roller pair, wherein the nip roller is configured to be located at either a holding position, at which the nip roller holds the sheet, and a non-holding position, at which the nip roller does not hold the sheet.

5. The image recording apparatus according to claim 4, further comprising a guide member arranged on a downstream side, in a sheet conveying direction, with respect to the holding member, and on an upstream side, in the sheet conveying direction, with respect to the roller pair, the guide member being configured to guide the sheet by contacting the sheet, wherein the nip roller and the guide member are arranged on a rear side with respect to the shaft in a state where the holder is attached to the holder.

6. The image recording apparatus according to claim 5, wherein the nip roller is arranged on an upper side with respect to the shaft in a state where the holder is attached to the housing, and on a lower side with respect to the guide member.

7. The image recording apparatus according to claim 5, wherein the holder comprises an outer wall constituting side surfaces of the housing in association with the right wall and the left wall.

8. The image recording apparatus according to claim 7, wherein the outer wall has a light transmissive window.

9. The image recording apparatus according to claim 7, wherein the guide member is configured to move between a first position and a second position, and wherein at least a part of the guide member located at one of the first position and the second position is located on a lower side with respect to an upper end of the outer wall in a state where the sheet roll holder is attached to the housing.

10. The image recording apparatus according to claim 1, wherein the holder is detachably attached to the shaft.

11. The image recording apparatus according to claim 1, wherein the holder is formed with a mark indicating a position at which a leading end of the sheet unwound from the sheet roll is to be located when the sheet roll is initially attached to the holder.

12. The image recording apparatus according to claim 1, further comprising an openable cover provided to the front wall; and a tank detachably attached to the housing and containing the ink, the tank being arranged immediately behind the cover in a state where the cover is closed, wherein the recording device is configured to eject the ink.

13. The image recording apparatus according to claim 1, wherein the holder is configured to be withdrawn from a right-hand side of the housing when viewed from the front side of the housing.

* * * * *